US005197939A

United States Patent [19]

Cederkvist et al.

[11] Patent Number: 5,197,939

[45] Date of Patent: Mar. 30, 1993

[54] DECANTER CENTRIFUGE

[75] Inventors: Jan Cederkvist, Bagsvaerd; Bjarne Goddik, Lyngby, both of Denmark

[73] Assignee: Alfa-Laval Separation A/S, Soborg, Denmark

[21] Appl. No.: 623,794

[22] PCT Filed: Jun. 19, 1989

[86] PCT No.: PCT/DK89/00151

§ 371 Date: Feb. 5, 1991

§ 102(e) Date: Feb. 5, 1991

[87] PCT Pub. No.: WO89/12506

PCT Pub. Date: Dec. 28, 1989

[30] Foreign Application Priority Data

Jun. 21, 1988 [DK] Denmark ..... 3384/88

[51] Int. Cl.[5] ..... B04B 1/20; B04B 3/04; B04B 9/08

[52] U.S. Cl. ..... 494/53; 494/84

[58] Field of Search ..... 494/50, 51, 52, 53, 494/54, 55, 82, 83, 84, 85; 464/177, 181, 182, 160, 92, 98, 147

[56] References Cited

U.S. PATENT DOCUMENTS

| | | | |
|---|---|---|---|
| 1,188,113 | 6/1916 | Thomas | 464/147 |
| 2,614,748 | 10/1952 | Ritsch | 494/85 |
| 2,715,822 | 8/1955 | Anderson | 464/182 |
| 3,097,167 | 7/1963 | Beyerle | 494/83 |
| 3,187,997 | 6/1965 | Gooch | 494/53 |
| 3,428,246 | 2/1969 | Finkelston | 233/7 |
| 3,685,722 | 8/1972 | Nichols | 494/53 |
| 3,779,451 | 12/1973 | Lehman | 494/84 |
| 3,938,354 | 2/1976 | Lehman | 494/84 |
| 4,069,967 | 1/1978 | Crosby et al. | 233/1 C |
| 4,141,488 | 2/1979 | Gense | 494/53 |
| 4,186,096 | 1/1980 | Areaux | 494/50 |
| 4,190,194 | 2/1980 | Amero | 494/53 |
| 4,303,192 | 12/1981 | Katsume | 233/7 |
| 4,327,862 | 5/1982 | Jakobs | 233/7 |
| 4,339,072 | 7/1982 | Hiller | 494/52 |
| 4,362,521 | 12/1982 | Puck | 464/182 |
| 4,385,897 | 5/1983 | Mallet | 464/182 |
| 4,391,594 | 7/1983 | Hannibal | 464/92 |
| 4,513,566 | 4/1985 | Rajsigl | 494/82 |
| 4,540,385 | 9/1985 | Krude | 464/182 |
| 4,861,313 | 8/1989 | Zeiser | 464/160 |

FOREIGN PATENT DOCUMENTS

| | | |
|---|---|---|
| 152021B | 1/1981 | Denmark . |
| 0107470 | 1/1990 | European Pat. Off. . |
| 2070485 | 8/1971 | France . |
| 8706856 | 11/1987 | PCT Int'l Appl. . |
| 1395044 | 5/1975 | United Kingdom . |

*Primary Examiner*—Philip R. Coe
*Assistant Examiner*—Terrence R. Till
*Attorney, Agent, or Firm*—Banner, Birch, McKie and Beckett

[57] ABSTRACT

The decanter centrifuge comprises a bowl and conveyor screw rotatably journalled within the bowl and a reduction gear providing a relative rotation of the screw relative to the bowl. The gear is journalled separately relative to the bowl in separate bearings. The housing and the driven shaft of the gear are by means of flexural but torsionally stiff couplings connected with the bowl and conveyor, respectively. The flexural couplings result in that the gear is dynamically insulated from the bowl and does not influence the critical number of revolutions thereof. As a result of this the number of revolutions of the bowl, and thus maximum allowable number of revolutions of the entire centrifuge, may be increased, thereby offering substantially improved separating properties of the centrifuge as a whole.

1 Claim, 1 Drawing Sheet

DECANTER CENTRIFUGE

Figure 1:
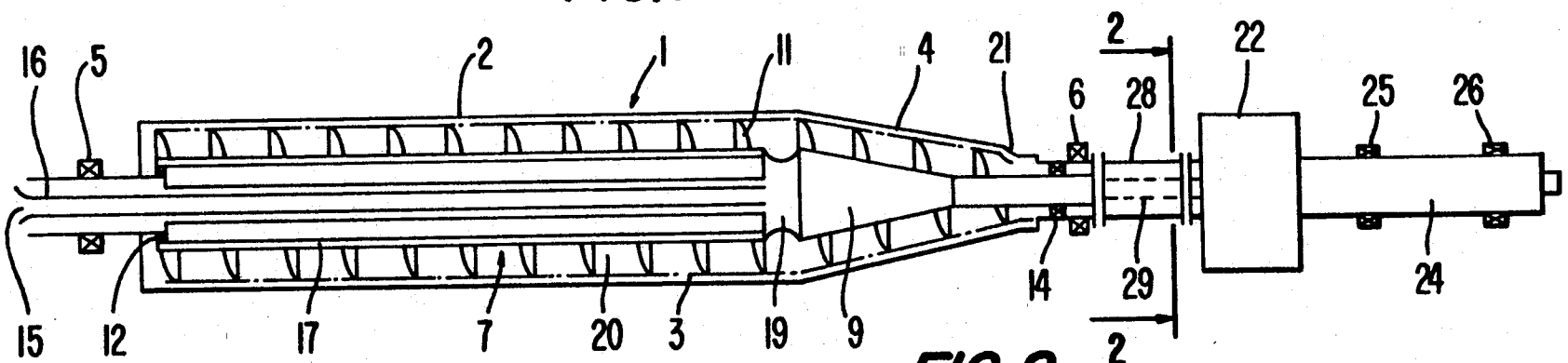

This invention relates to a decanter centrifuge comprising a rotatably journalled bowl and a rotatable screw conveyor journalled in the bowl and of the type in which the conveyor is connected with the bowl through a reduction gear provided with a housing co-rotating with the bowl, a driven shaft connected with the conveyor, and a drive shaft whose number of revolutions determines the relative number of revolutions of the conveyor relative to the bowl.

WO87/06856 describes a decanter centrifuge in which the housing of the reduction gear is co-rotating with the bowl and from FR-A 2,070,485 it is known to attach the housing of the reduction gear fixedly to a flange at one end of the bowl.

From U.S. Pat. No. 3,685,722 it is known to connect the shafts between the co-rotating gear and the conveyor and/or the bowl of a decanter centrifuge through torsionally flexible couplings in order to prevent strain on the gear-wheels of the reduction gear due to so called "chatter" or frequent large fluctuations in torque on the conveyor.

Such decanter centrifuges are used for separating a liquid/solids mixture supplied to the interior of the bowl into a solids phase and one or more liquid phases. This is obtained by rotating the entire bowl at a high number of revolutions and driving at the same time the conveyor at a compartively low number of revolutions relative to the bowl, that is effected by means of the reduction gear which may either be mechanical or hydraulic. Due to the high number of revolutions of the bowl it is in all general applications only possible to transfer the necessary torque between conveyor and bowl by means of such a co-rotating gear.

The separating effect of the centrifuge and its capacity depend on the number of revolutions and the inner diameter of the bowl and on the length of the separating space in such a manner that an increase of each of said parameters, other things being equal, will cause an increase of the separating effect and/or the capacity.

The separating effect and the capacity of the centrifuge are, however, restricted by the critical number of revolutions of the rotating system and is further limited in practice in that an allowable maximum number of revolutions which is somewhat lower than the critical number of revolutions is stipulated considering the stresses occurring in the rotating parts and the working conditions of the centrifuge, such as expected wear, vibration of the decanter as a whole, and so on.

The critical number of revolutions depends, inter alia, on the mass of the rotating parts and, by reducing said mass, the critical number of revolutions may be increased. In view of the fact that the above mentioned co-rotating gear constitutes a substantial portion of the total rotating mass in a decanter centrifuge, it may be desirable to separate the gear from the bowl in order to increase the critical number of revolutions of the decanter centrifuge.

The decanter centrifuge according to the invention is characterized in that the reduction gear is rotatably journalled in separate bearings, in that its housing is connected with the bowl through a flexural but torsionally stiff coupling, and in that the driven shaft of the reduction gear and the conveyor are likewise connected through a flexural but torsionally stiff coupling.

By supporting the gear in separate bearings and eliminating the possibility of transferring bending moments from the gear to the bowl and the conveyor there is obtained a structure in which the gear, from a dynamic point of view is largely completely insulated from the latter components and thus does not exert any influence on the critical number of revolutions of the decanter centrifuge. This produces the advantage over the prior art centrifuges of the above-mentioned type that the allowable maximum number of revolutions of the centrifuge according to the invention may be increased or, for example, that the length of the separating space may be increased without increasing the critical number of revolutions. In both cases the result is an increase of the separating effect and/or the separating capacity.

In many cases, the indicated location of the reduction gear results in a series of additional advantages. For instance, when processing very hot products there is some risk in conventional decanter centrifuges that the gear, which is disposed in immediate heat-conducting contact with the bowl, becomes overheated. In case of a mechanical gear, such overheating may cause a reduction of the gear lubricating oil viscosity, that at worst, can result in an expensive gear breakdown. It will be recognized that arranging the gear on separate bearings results in a substantial reduction of the possibility of heat transfer between the bowl and the gear.

Such a decreased heat transfer is further advantageous if the processed product is very sensitive to temperature and does not tolerate heating during the separation in the bowl. This applies, for instance, to various biotechnological processes. In this case too, it is an obvious advantage that the heat generated in the gear due to loss of effect is transferred to the bowl and, thus, to the product.

In use, a decanter is frequently subjected to substantial wear, particularly of the conveyor. Such wear may change the equilibrium of the decanter to such a degree that even in normal operation undesired vibrations occur which, moreover, often grow worse due to the presence of the relatively heavy gear. Decanter centrifuges with the gear positioned directly on the bowl are, moreover, sensitive to imbalance in the gear itself. As regards balancing, it is therefore also a considerable advantage that the gear is a separate dynamic unit that does not influence the vibration conditions of the bowl.

Figure 2:
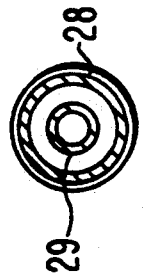

The invention will now be explained with reference to the accompanying drawing illustrating a decanter centrifuge in which FIG. 1 is a cross-sectional diagrammatic representation of a decanter centrifuge according to the invention and FIG. 2 is an enlarged diagrammatic transverse sectional view taken along line 2—2 of FIG. 1.

As shown, the decanter centrifuge 1 comprising horizontal, axially symmetrical bowl 2 including a cylindrical section 3 and a conical section 4 and which is rotatably supported in stationary bearings 5 and 6. The bowl 2 includes an elongated screw conveyor 7 which, by means of bearings 12 and 14, is rotatably journalled in relation to the bowl and consists of a central body portion 9 surrounded by a continuous screw flight 11.

The suspension to be separated in centrifuge 1 is supplied through an inlet 15 of an inlet tube 16 extending coaxially with the axis of rotation of the centrifuge through a central passage 17 provided in conveyor body 9. The tube 16 ends in a transverse, radial passage 19 opening out into the separating space 20 of the centrifuge. After separation in this space the solids are discharged through radial apertures 21, while the liquid is discharged through one or more outlets, not shown, at the opposite end of the bowl.

The relative rotation of the screw conveyor in relation to the bowl is provided by means of a gear 22—e.g. an epicyclic gear—positioned on a conventionally driven separate shaft 24 rotatably journalled in stationary bearings 25 and 26. The housing and the driven shaft of the gear are, via two co-axial flexural but torsionally stiff couplings 28 and 29, connected with the bowl 2 and the screw conveyor 7, respectively.

The use of such a flexural coupling, the structure of which is, incidentally, well known, results in a gear that, dynamically speaking, is almost completely separated from the bowl so that the mass of the gear does not influence the critical number of revolutions of the bowl.

As stated by way of introduction, this permits the maximum allowable number of revolutions of the bowl and, thus, also of the centrifuge to be increased, resulting in a substantially improved separating capability and capacity.

We claim:

1. A decanter centrifuge (1) comprising a rotatable bowl (2) and a screw conveyor (7) rotatable within said bowl, journal means for rotatably supporting said bowl and said screw conveyor including bearings (5, 6) for rotatably supporting said bowl and means for journalling said screw conveyor within said bowl for rotation relative thereto, said centrifuge further being of the type in which the screw conveyor (7) is connected with the bowl (2) through a reduction gear (22) having a housing co-rotating with the bowl (2), a driven shaft connected with the screw conveyor (7) and a drive shaft whose number of revolutions determines the relative number of revolutions of the screw conveyor (7) with respect to the bowl (2), characterized in that the reduction gear is rotatably supported by bearings (25, 26) forming journal means independent from the bowl and from journal means rotatably supporting said bowl (2) and said screw conveyor (7) and that the housing of said reduction gear (22) is connected with the bowl (2) through a flexural, but torsionally stiff, coupling (28), and in that the driven shaft of the reduction gear (22) and the screw conveyor (7) are likewise connected through a flexural, but torsionally stiff coupling (29).

* * * * *